United States Patent [19]

de Palézieux

[11] 4,448,245

[45] May 15, 1984

[54] RADIATOR

[75] Inventor: Jacques de Palézieux, Hauterive, Switzerland

[73] Assignee: Runtal Holding Company S.A., Glarus, Switzerland

[21] Appl. No.: 350,354

[22] Filed: Feb. 19, 1982

[30] Foreign Application Priority Data

Mar. 12, 1981 [CH] Switzerland ..... 1678/81

[51] Int. Cl.[3] ..... F28F 9/02

[52] U.S. Cl. ..... 165/174; 165/178; 165/DIG. 9; 228/183

[58] Field of Search ..... 165/172–175; 285/286; 219/59.1, 67; 228/138, 183, 189, 121, 129, 130, 178; 248/68 R, 58; 126/448

[56] References Cited

U.S. PATENT DOCUMENTS 4,090,657 5/1978 Anderson ..... 228/189 X

FOREIGN PATENT DOCUMENTS

| | | | |
|---|---|---|---|
| 746519 | 7/1970 | Belgium | 228/189 |
| 269861 | 7/1950 | Switzerland | 228/138 |
| 592290 | 10/1977 | Switzerland . | |
| 1051601 | 12/1966 | United Kingdom | 165/153 |

*Primary Examiner*—William R. Cline

*Attorney, Agent, or Firm*—Watson, Cole, Grindle & Watson

[57] ABSTRACT

In a radiator having flat tubes arranged in parallel and connected to header pipes for feed and return flow, each flat tube has two connection bores near the front end thereof. To enable the radiator to be manufactured by the use of pressure welding, a support part, angled into U-form with two bent ends arranged coaxially with the two connection bores, is inserted into each flat tube. These ends of the support part prevent the flat tube from being pressed inwardly during pressure welding. The portion of the support part extending parallel with the end edge of the flat tube is welded to the tube end edge, so that the support part simultaneously also forms the end closure wall of the flat tube.

6 Claims, 9 Drawing Figures

RADIATOR

BACKGROUND OF THE INVENTION

1. Field of the Invention

The invention relates to a radiator or heater having flat tubes arranged in parallel and connected to header or manifold pipes for feed and return flow, in which tubes support parts for transmitting the welding pressure and are arranged in the region of the connecting bores on the mutually opposite inner walls.

2. Description of the Prior Art

A radiator of this kind has been proposed in which the header pipes are arranged on the rear of the flat tubes which are coplanar and are connected to the header pipes by means of projection welding. In this rational manufacturing technique all the connections can be produced at the same time, the one electrode of a welding machine being pressed against the header pipes and the other electrode against the flat tubes, with a pressure of up to 800 kg. In order that the flat tubes are not deformed thereby, support parts bearing upon the opposite inner walls of the flat tube are arranged within the flat tubes in the region of each of the connecting bores. To enable the projection welding method to be used, in the known radiator or heater it was proposed to press a zone of the wall surrounding each connecting bore of the header pipes or the flat tubes outwardly so that the projection welding can be carried out with the thus produced section protruding frusto-conically from the surface of the tube or pipe (Swiss Pat. No. 592,290).

According to another, earlier proposal, intermediate bush-like pieces are welded into the flat tubes at every connecting bore, which pieces extend through the whole of the interior of the flat tubes and protrude to one side beyond these, so that they can take up the welding pressure to be applied in projection welding, and the protruding ends of these intermediate pieces can be attached at the same time for all connections to the header pipes by means of projection welding. This method, however, has the disadvantage that the intermediate pieces to be inserted into the flat tubes have to be welded into the flat tubes by means of oxy-acetylene or $CO_2$ welding.

For the production of such a radiator the flat tubes, which are manufactured in long lengths, must be cut to the desired length in each case and closed at the ends, if the header pipes are to be attached to the rear of the flat tubes. The problem of the closure of the ends of the flat tubes is eliminated in other known types of construction of radiators where the flat tubes open at their ends into the header pipes arranged on the end. In the initially mentioned known radiators the flat tubes are closed at their ends by a welded-in cover following the fitting of the support parts, which have to be arranged previously at every connecting bore, into the flat tube. This method requires much skill and is not very economical. When especially flat tubes are used, their ends can also be closed by welding of the previously inwardly bent marginal zones of the tube walls which lie closely opposite one another by reason of the small internal width. This, however, again requires a prior deformation of the flat tube ends.

SUMMARY OF THE INVENTION

The problem on which the present invention is based includes a radiator which can be produced rationally with minimal working of the parts to be joined together and using pressure welding. This problem is solved by the measures set forth herein. The advantages of the radiator according to the invention consist in that deformation of the flat tube ends is not necessary for their closure by welding, and in that with the support parts necessary for the projection welding an end closure wall is at the same time inserted into the tube, by the welding-in of which the support parts are fixed at the correct position in the region of the connecting bores.

BRIEF DESCRIPTION OF THE DRAWING

Preferred embodiments of the subject-matter of the invention are explained in greater detail below with reference to the drawings, wherein.

DESCRIPTION OF THE PREFERRED EMBODIMENTS

Figure 1:
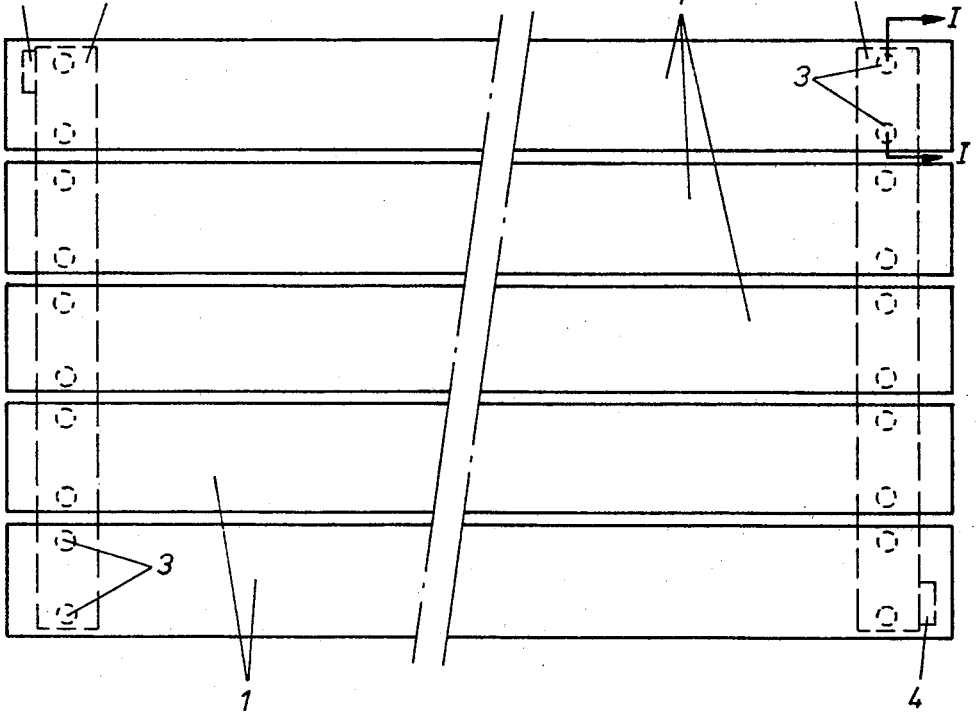
FIG. 1 shows a front elevation of the radiator.

According to FIG. 1, the radiator comprises a plurality of coplanar, slightly spaced-apart flat tubes 1 arranged horizontally in parallel with one another, which are connected at their rear at a distance from the ends of the flat tubes to vertical header pipes 2 for feed and return flow. Each of the flat tubes 1 is connected to the same header pipe 2 through two connections 3 of which the one lies close to the upper edge and the other close to the lower edge of the flat tube, so that the flat tubes can be vented and emptied without difficulty. Each of the header pipes 2 has a connection 4 to which the supply conduit or discharge conduit for the heating medium is connected. The connections 3 between the flat tubes and the header pipes are formed by connecting rings 3 which are welded to the flat tube and the header pipe by means of projection welding or pressure welding.

Figure 2:
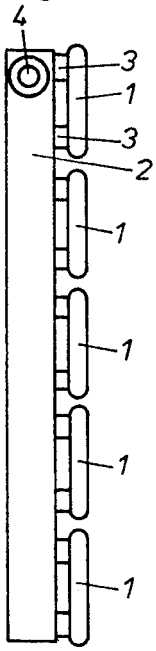
FIG. 2 shows a side elevation of the radiator with flat tubes on one side of the heater (manifold) pipes.
Figure 3:
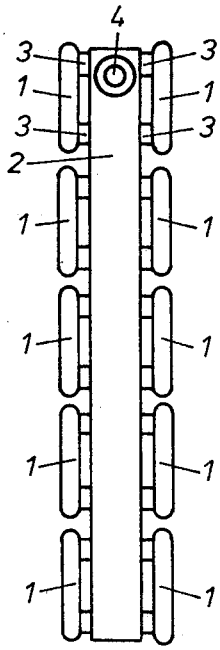
FIG. 3 shows a side elevation of a further embodiment of the radiator, with flat tubes on both sides of the header pipes.

It is manifest from FIGS. 2 and 3 that the flat tubes 1 can be arranged on one side of the header pipes 2 or equally in planes parallel with one another on the opposite sides of the header pipes 2. The annular form of the connecting rings 3 can be seen from FIGS. 7 and 8. In addition, convector fins can be welded to the flat tubes.

Figure 5:
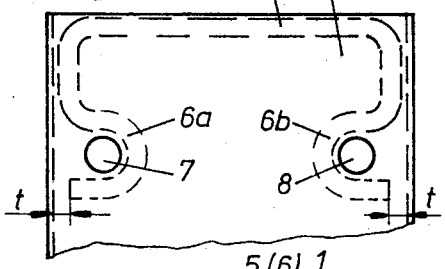
FIG. 5 shows the end of a flat tube, like FIG. 4, but with a differently shaped support part.
Figure 6:
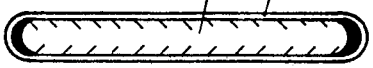
FIG. 6 is a plan view of the flat tube end closed by the support part.

In the production of the radiator the flat tubes are cut to the requisite length and closed at the ends. According to FIGS. 4 to 6 for this purpose at the end of each flat tube 1 a support part 5 according to FIG. 4, or a somewhat differently shaped support part 6 according to FIG. 5, is welded-in, which support parts are of approximately the same width as the internal width of the flat tube, are angled in U-form and have two bent-over ends 5*a*, 5*b* or 6*a*, 6*b*, respectively, which coaxially surround, over a part of their circumference, the connection bores 7 and 8 formed at a distance from the ends of the flat tube and on both sides at a distance from the longitudinal central axis of the flat tube, in the tube wall. The difference between the support parts 5 and 6 according to FIGS. 4 and 5 consists merely in that the bent ends 5*a*, 5*b* and 6*a*, 6*b*, which are each formed in mirror symmetry with respect to one another in relation to the longitudinal axis of the flat tube, are bent differently around the centre of the connection bore. These bent ends of the support part 5 or 6 arranged in the interior of the flat tube transmit the welding pressure in the course of manufacture of the radiator employing pressure welding. The portion of the support parts 5 or 6 extending parallel with the end of the flat tube 1 at the same time forms the end closure wall of the flat tube and for this purpose is welded according to FIG. 6 with a double weld seam, or with a wide weld seam, into the flat tube end. By this welding the bent ends 5*a*, 5*b*, or 6*a*, 6*b* are fixed in the correct position in relation to the connection bores 7 and 8. Thus a prior deformation of the flat tube ends for their closure by welding or the welding-in of a separate closure wall, after support rings have previously been inserted into the flat tube, is obviated.

Figure 7:
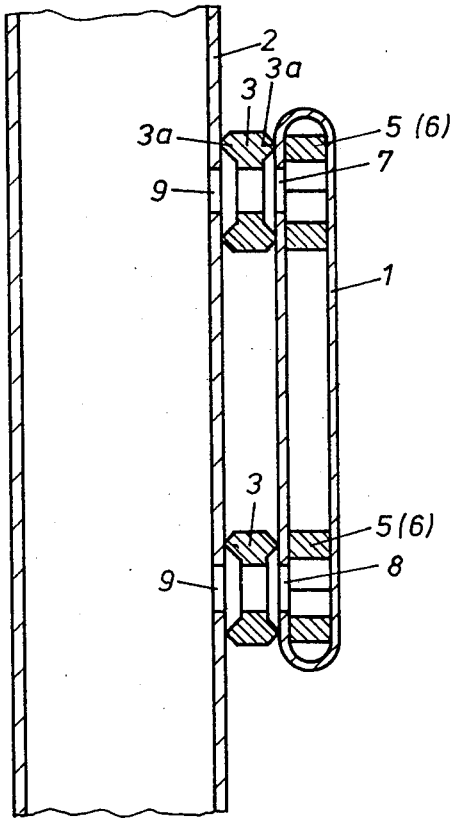
FIGS. 7 and 8 show vertical sections through the header pipe and flat tube along the line I-I in FIG. 1, on a larger scale, with first and second embodiments of the connecting rings.
Figure 8:
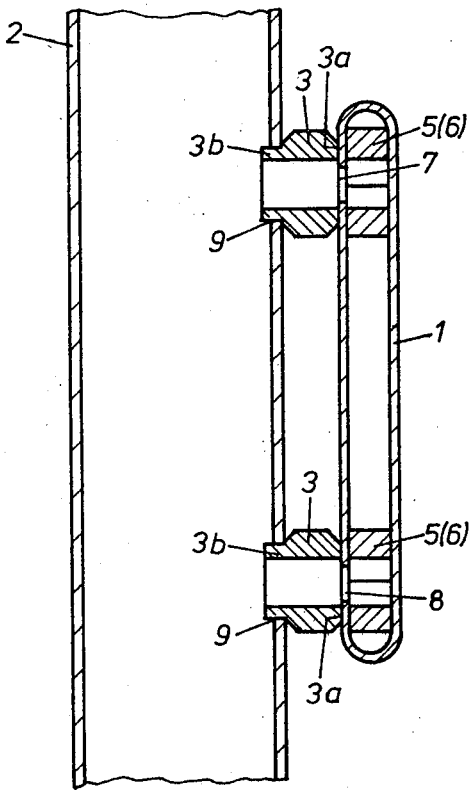

According to FIGS. 7 and 8 the connecting rings or welding rings 3 are each arranged coaxially with the connection bore 7 or 8 between a header pipe 2 and the flat tubes 1 to be connected thereto. These connecting rings 3 have the function of producing a mechanically firm connection between the flat tubes and the header pipe; and furthermore the connecting rings enable the achievement of a gap to be present between the tubes and pipes, so that after the radiator has been completed by projection welding or pressure welding, any still leaky welded connections can subsequently be rendered tight by an additionally welded annular body or by soldering.

The connecting rings 3 enable the simultaneous production of all connections between the flat tubes and the two header pipes of a radiator. For this purpose the connecting rings 3 may take different forms. The welding ring 3 according to FIG. 7 has annular protuberances 3*a* formed by turning on the two ends, which are weldled tightly to the surfaces of header pipe and flat tube in the pressure welding. The connecting ring 3 according to FIG. 8 has an annular protuberance 3*a* at only one end; while at the other end an annular centering projection 3*b* is formed with which the connecting ring is inserted into the connection bore 9 of the header pipe 2, the latter having connection bores 9 formed in the header pipe wall at the same spacing as that between the connection bores 7 and 8 in each flat tube 1. The connecting ring 3 may conversely also be inserted with the centering projection 3*b* into the connection bore 7 or 8 of the flat tube, or it is also possible to use a connecting ring having a centering taper at both front ends.

Figure 4:
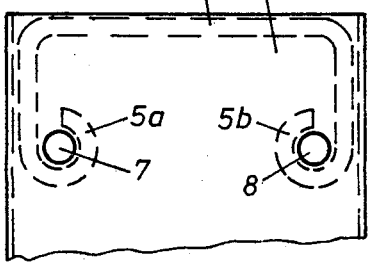
FIG. 4 is a broken-away view of the end of a flat tube with an inserted support part, on a larger scale.
Figure 9:
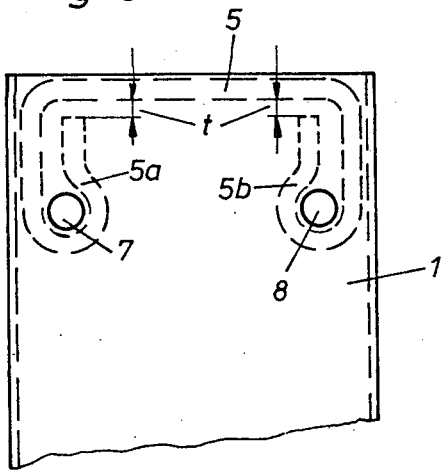
FIG. 9 shows the end of a flat tube with a further modified form of the support part.

FIG. 9 shows that in the support part 5, in deviation from the embodiment according to FIG. 4, the somewhat longer bent ends 5*a* and 5*b* extend with their twice-bent end sections parallel with the narrow side edges of the flat tube to a short distance before the section of the support part which closes off the end of the flat tube, so that only a clearance t remains for the passage of the heating medium. In the case of a radiator with vertically arranged flat tubes therefore an air cushion corresponding only to this clearance t remains in the flat tube, which can therefore be extensively vented. This applies in the same way in the case of a radiator with horizontally arranged flat tubes, for the distance t in the form of embodiment according to FIG. 5.

I claim:

1. A radiator comprising mutually parallel flat tubes connected to header pipes for the feed and return flow of the heating medium, said flat tubes having connection bores formed at a distance from each end of each said flat tube and on opposite sides at a distance from the longitudinal axis of the tube, and said flat tubes having inside support parts resting against the mutually opposite inner tube walls in the region of the connection bores, the improvement wherein each said support part is angled into a U-shape of approximately the same width as the internal width of the tube, said support part having two bent ends each of which being formed for coaxially surrounding a portion of the circumference of one of the connection bores, said support part also forming the end closure wall of the flat tube and being welded thereto along the end edge of the tube, the header pipes having connection bores in alignment with the flat tube connection bores, connecting rings provided for connecting the flat tubes and header pipes together, the connecting rings having tapered end faces for applying pressure welding and being disposed in alignment with the aligned connection bores coaxially with each bent end of the U-shaped support part for connecting by pressure welding the flat tubes to the header pipes.

2. A radiator according to claim 1, wherein the bent ends of the support part are arranged mirror-symmetrically to one another in relation to the longitudinal axis of the flat tube.

3. A radiator according to claim 1 or 2, wherein on at least one end face of each connecting ring there is a turned annular protuberance for welding with the wall of the flat tube or of the header pipe.

4. A radiator according to claim 1, wherein at least one of the tapered end faces of the connecting rings has an annular centering projection for insertion into at least one of the connection bore of the flat tube and of the connection bore of the header pipe.

5. A radiator according to claim 1, wherein the bent ends of each support part extend in a horizontally arranged flat tube as far as a distance 't' shortly before the horizontally extending inner wall of a domed narrow tube side extending parallel to the axis of the tube.

6. A radiator according to claim 1, wherein the bent ends of each support part extend in a vertically arranged flat tube as far as a distance "t" shortly before the horizontally extending inner wall of the section of the support part forming the end closure wall of the flat tube.

* * * * *